United States Patent [19]

Hörnschemeyer

[11] Patent Number: 4,795,185

[45] Date of Patent: Jan. 3, 1989

[54] HEEL PIECE FOR SAFETY SKI BINDING

[75] Inventor: Heinz Hörnschemeyer, Oberammergau, Fed. Rep. of Germany

[73] Assignee: Marker Deutschland GmbH, Garmisch-Partenkirchen, Fed. Rep. of Germany

[21] Appl. No.: 151,442

[22] Filed: Feb. 2, 1988

[30] Foreign Application Priority Data

Feb. 2, 1987 [DE] Fed. Rep. of Germany ..... 3703008

[51] Int. Cl.[4] ..... A63C 9/08

[52] U.S. Cl. ..... 280/632

[58] Field of Search ..... 280/626, 628, 631, 632, 280/633

[56] References Cited

U.S. PATENT DOCUMENTS

| | | | |
|---|---|---|---|
| 3,545,782 | 12/1970 | Salomon | 280/632 |
| 3,697,094 | 10/1972 | Salomon | 280/632 |
| 4,444,413 | 4/1984 | Richert et al. | 280/632 |
| 4,449,731 | 5/1984 | Knabel et al. | 280/632 |
| 4,451,059 | 5/1984 | Knabel et al. | 280/632 |
| 4,457,534 | 7/1984 | Richert | 280/631 |
| 4,466,634 | 8/1984 | Knabel et al. | 280/632 |
| 4,484,763 | 11/1984 | Sedlmair | 280/618 |
| 4,489,956 | 12/1984 | Jungkind | 280/632 |
| 4,615,536 | 10/1986 | Stritzl et al. | 280/631 |
| 4,693,489 | 9/1987 | Stepanek et al. | 280/634 |

FOREIGN PATENT DOCUMENTS 2803647 8/1979 Fed. Rep. of Germany .

*Primary Examiner*—David M. Mitchell
*Assistant Examiner*—Michael Mar
*Attorney, Agent, or Firm*—D. Peter Hochberg; Mark M. Kusner; Louis J. Weisz

[57] ABSTRACT

A heel piece of a safety ski binding, said heelpiece comprising: a base attachable to a ski; opposed vertical support members mounted on said base, each support member including a track formed by an outwardly curved surface terminating in first and second end surfaces extending at an angle thereto; a soleholder mounted on said support members for pivotal movement about an axis transverse to said support members between a closed position for securing a ski boot and an open position for releasing said ski boot, said soleholder including a track formed by an inwardly curved surface terminating in first and second end surfaces extending at an angle thereto, said inwardly curved surface being contiguous with said outwardly curved surface and movable relative thereto such that said sole holder end surfaces are movable past said end surfaces of said support members; a first movable roller operable to engage said first end surfaces and said curved surfaces of said support members and said soleholder;

a second movable roller operable to engage said second end surfaces and said curved surfaces of said support members and said soleholder; tension means disposed between and connected to said first and second rollers for biasing said rollers toward each other, said rollers being maintained in a spaced apart location by said respective surfaces of said support members and said soleholder wherein said first roller is movable between engagement with said first end surface of said soleholder and said first end surface of said support members as said soleholder moves between said closed position and said open position, said tension means exerting a biasing force on said soleholder to maintain said soleholder in said closed position when said first roller is in engagement with said first end surface of said soleholder, and lever means pivotally mounted on said support members, said lever means including a cam slot for receiving and guiding the ends of said first roller, said lever means being members operable to move said first roller from engagement with said first end surface of said soleholder when said soleholder is in the closed position to engagement with said first end surfaces of said support members when said soleholder is in the open position wherein said second roller engages said second end surface of said support member when said soleholder is in said closed position, and wherein said second roller engages said second end surface of said soleholder when said soleholder is in said open position.

6 Claims, 3 Drawing Sheets

HEEL PIECE FOR SAFETY SKI BINDING

FIELD OF THE INVENTION

The present invention relates to safety ski bindings, and more particularly to a heelholding device for a safety ski binding.

BACKGROUND OF THE INVENTION

The present invention relates to heelholding devices of the type shown in German application No. DE 2803647 Al, which discloses a device including an opening lever operable by tension. The opening lever is movably mounted in the carrying member and is parallel to the soleholder. The disclosed arrangement is designed such that for a manual opening of the device ("manual opening" meaning an opening by operation of the opening lever as compared to an opening due to an excessive force exerted by the ski boot), the operative rolling member (which is the trailing one in the direction of the opening movement of the soleholder) is initially influenced by the opening lever in a direction which exerts a greater holding force on the soleholder and maintains it in a closed, heelholding position. In other words, the initial effect of the opening lever in the disclosed device is to hold more tightly the heel in the binding.

This manner of operation is not desired for several reasons. For example, the initial increase in the holding or locking force produces an unfavorable sequence of motions for an individual to manually "step-out" of the binding. In the disclosed device, the initial increase in holding force is followed by a sudden releasing force in the opposite direction. This force produces a sudden movement of the soleholder in an opening direction rather than an immediate free release. In this respect, the actuation of the opening lever will not initiate an immediate pivotal "opening" movement of the soleholder because as set forth above, the initial effect of the opening lever is to increase the holding or locking force on the soleholder.

These and other problems are overcome by the present invention which provides a soleholder of the general type disclosed in the above-referenced to patent, wherein operation of the opening lever immediately removes the holding force on the soleholder and permits free movement of the soleholder.

SUMMARY OF THE INVENTION

It is an object of the present invention to provide a heelholding device for a safety ski binding which is operable to immediately release the soleholder upon actuation of the opening lever.

Another object of the present invention is to provide a heelholding device as described above wherein the soleholder is freely movable upon actuation of the opening lever.

A still further object of the present invention is to provide a heelholding device as described above having a simplified structure which is easy and economical to manufacture.

In accordance with the present invention, there is provided a heelpiece for a safety ski building. The heelpiece comprises a base attachable to a ski having support means mounted thereon. The support means include an outward facing surface terminating in first and second end surfaces. A soleholder is mounted on the support means for pivotal movement about an axis transverse to the support means between a closed position for holding a ski boot and an open position for releasing the ski boot. The soleholder includes an inwardly facing surface terminating in first and second end surfaces, the inwardly facing surface being contiguous with the outwardly facing surface of the support means and movable relative thereto such that the soleholder end surfaces are movable past the support means end surfaces. A first movable actuating member is provided and operable to engage the first surface of the support means and the soleholder. A second movable actuating member is provided and operable to engage the second surfaces of the support means and the soleholder. Tension means are disposed between and connected to the first and second actuating members. The actuating members are maintained spaced apart by the respective surfaces of the support means and the soleholder wherein the first actuating member is movable between engagement with the first end surface of the soleholder and the first end surface of the support means as the soleholder moves between the closed position and the open position. The tension means exert a biasing force on the soleholder to maintain the soleholder in the closed position when the first actuating member is in engagement with the first end surface of the soleholder. Lever means pivotally mounted to the support means are provided and operable to move the first actuating member from engagement with the first surface of the soleholder to engage with the first surface of the support means.

More specifically, the actuating members are comprised of cylindrical rollers. The rollers may be comprised of a single element or may be comprised of a separate axle having a roller member thereon. The lever means defined above represent an opening lever for the soleholder, which opening lever is preferably coaxially mounted with the soleholder. One of the rollers (the one closest to the opening lever and the one in direction of the opening movement of the soleholder) is mounted within a slot formed in the opening lever. The slot formed in the opening lever has a predetermined shape, and has a "guiding" portion which extends along a radial line from the axis of the lever. The guiding portion of the slot is dimensioned in the radial direction to be generally twice the diameter of the rolling member to facilitate operative engagement of the roller with the operative surfaces of the soleholder and the support means. This slot preferably includes a second portion which extends along a line defined by the movement of the opening lever and which is generally tangential with respect to the pivot axis of the opening lever. The second portion of the slot provides a device wherein the opening lever will not be compelled to follow the movements of the heelholder in the so-called "elastic" range of the binding. The present invention thus provides a heelholding device wherein the holding force on the soleholder will be released immediately when the opening lever is actuated. Consequently, the soleholder may move freely and can immediately be swung up (open) without exertion of external force.

The tensioning means disposed and connected between the first and second actuating members is preferably comprised of a helical tension spring. A gas spring may also be used to provide the tensioning means between the actuating members. A spring cage containing a compression spring may also be used in a manner as is conventionally known.

In accordance with another aspect of the present invention, a retaining spring may be provided between the opening lever and the soleholder to move the soleholder to an open position automatically when the opening lever is actuated. In this respect, it has been found suitable to provide a retaining spring which consists of a helical tension spring which is movably mounted on the pivot for the soleholder.

These and other objects and advantages will become apparant from the following description of the preferred embodiment of the invention taken together with the accompanying drawings.

DRAWINGS

The invention may take physical form in certain parts and arrangement of parts, an embodiment of which is described in detail in the specification and illustrated in the accompanying drawings wherein;

FIG. 1 is a longitudinal sectional view taken on line I—I in FIG. 2 of a heelholding device illustrating a preferred embodiment of the present invention, FIG. 2 is a transverse sectional view taken on line II—II in FIG. 1, FIG. 3 is a view of the heelholding device shown in FIG. 1 illustrating an instantaneous position for a spontaneous release, FIG. 4 is a view of a heelholding device shown in FIG. 1 illustrating the soleholder in an open position, FIG. 5 is a view of the heelholding device shown in FIG. 1 illustrating the opening lever which has been actuated, and FIG. 6 is a view of the heelholding device shown in FIG. 1 illustrating a soleholder which has been opened manually.

DETAILED DESCRIPTION OF THE PREFERRED EMBODIMENT

Figure 1:
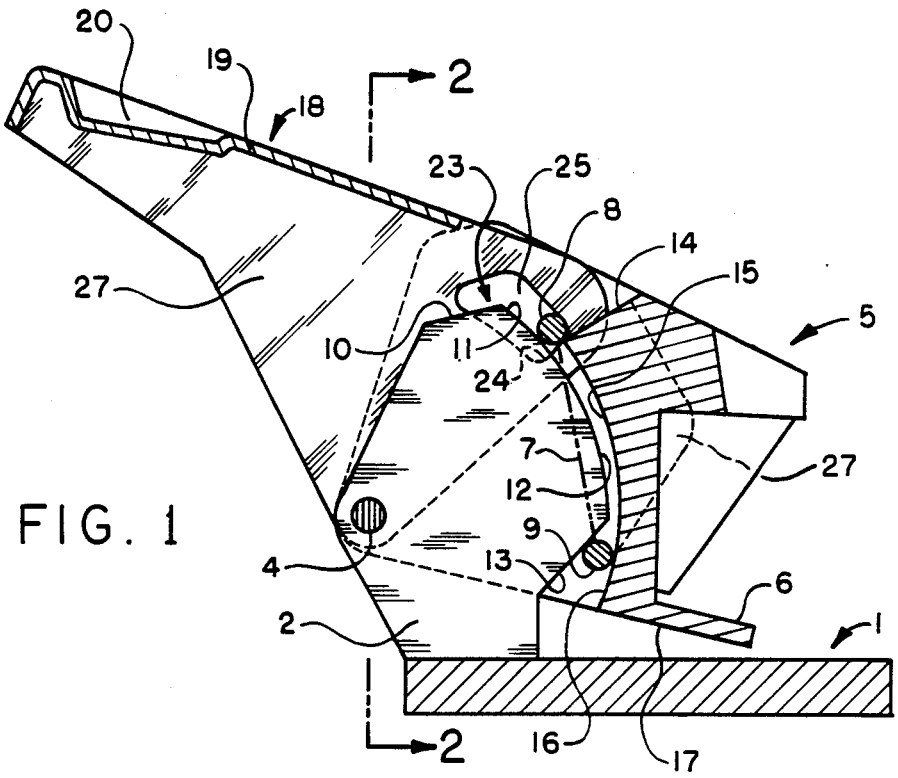
Figure 2:
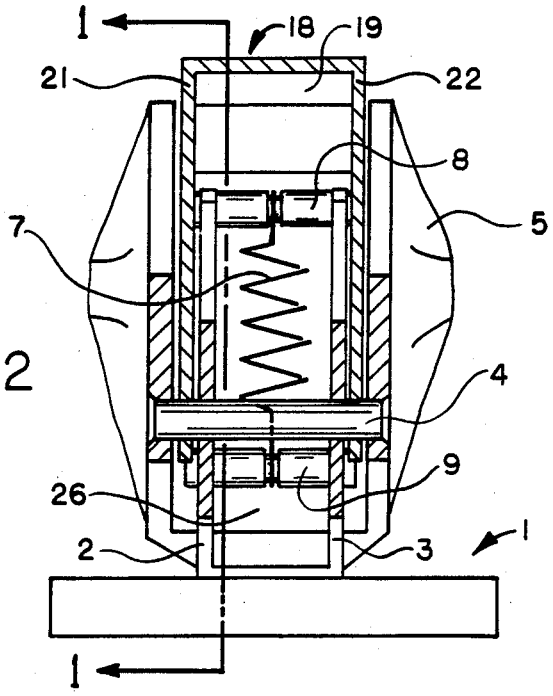

Referring now to the drawings wherein the purpose is for illustrating a preferred embodiment of the invention only and not for the purpose of limiting same, FIG. 1 shows a heelholding device for a safety ski binding comprised of a carrying member 1, which is adapted to be secured to a ski in a conventionally known manner. For instance, the carrying member may be directly mounted on the ski, may be indirectly mounted by means of a turntable, or may be mounted by means of a rail-like baseplate which permits a longitudinal displacement. Two support members 2, 3 which are parallel to each other, extend vertically from the base of carrying member, as seen in FIG. 2. Support members 2, 3 carry a pivot pin 4, which is parallel to the surface of the ski and transverse to the longitudinal axis of the ski. A soleholder 5 is pivotally mounted on pivot pin 4 and is provided with a closing pedal 6. The soleholder 5 is biased by a helical tension spring 7, which is mounted at both ends to actuating members or rolling member 8 and 9 (see FIG. 2). Support members 2, 3 are contingent, with each member having a track for operative engagement with rolling members 8, 9. The track is generally comprised of surfaces 10, 11 and 12, 13. The soleholder 5 has also a track for engagement with rolling members 8, 9. The track on soleholder 5 is comprised of the surfaces 14, 15 or 16, 17. In other words, support members 2, 3 include an outward facing surface defined by surfaces 11, 12 terminating in end surfaces 10, 13; and soleholder 5 includes an inward facing surface defined by surfaces 15, 16 terminating in end surfaces 14, 17. As best seen in FIG. 1, the end surface of each track extends at an angle with respect to the inwardly and outwardly facing surfaces of the soleholder 5 and support members 2, 3 and the inwardly and outwardly facing surfaces of the support members 2, 3 and soleholder 5, i.e. surfaces 12, 16 and 11, 15, are curved about the pivot pin 4. In the position of the binding shown in FIG. 1, the surfaces 11 and 14 constitute a restraining recess for the rolling member 8 and the surfaces 13, 16 constitute a restraining recess for the rolling member 9.

The heelholding device also includes an opening lever 18, which consists of a pressure-applying lever and is formed by a substantially channel-shaped sheet metal stamping. The web 19 is provided with a depression 20, which serves to receive the tip of a ski pole. By means of its flanges 21, 22, the opening lever 18 is also movably mounted on carrying member 1 by the pivot pin 4. Each flange has a cam slot 23, which receives one end of the rolling member 8. The cam slot includes a "guiding" section 24, which in the preferred embodiment has a length that corresponds to twice the diameter of the rolling member. Guiding section 24 is aligned radial to the pivot pin 4. The cam slot also provides a clearance 25, which extends from the guiding section 24 and is substantially tangential with respect to the pivot pin 4. Clearance 25 permits an adequate movement of the rolling member 8 without entraining the opening lever 18.

Figure 3:
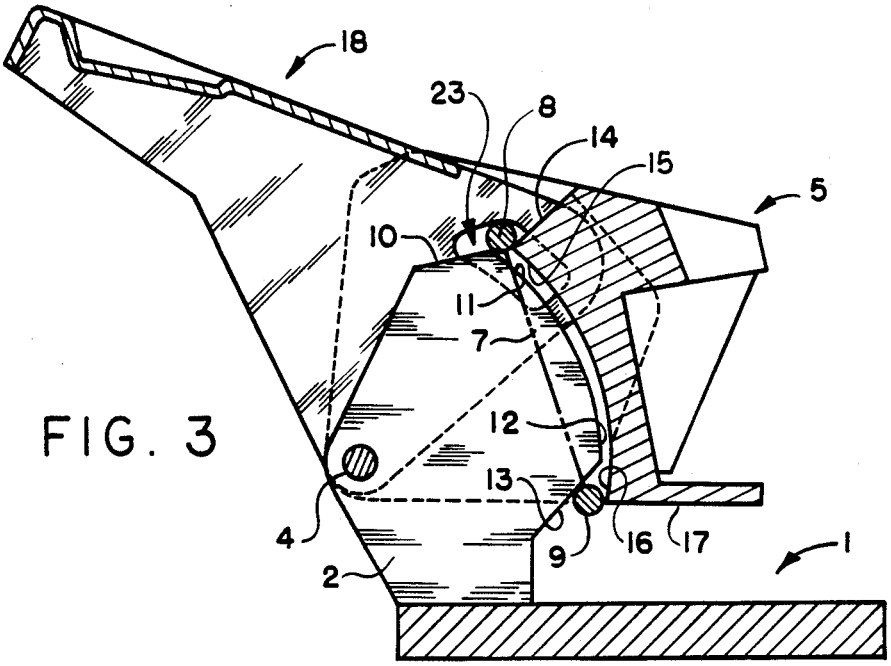
Figure 4:
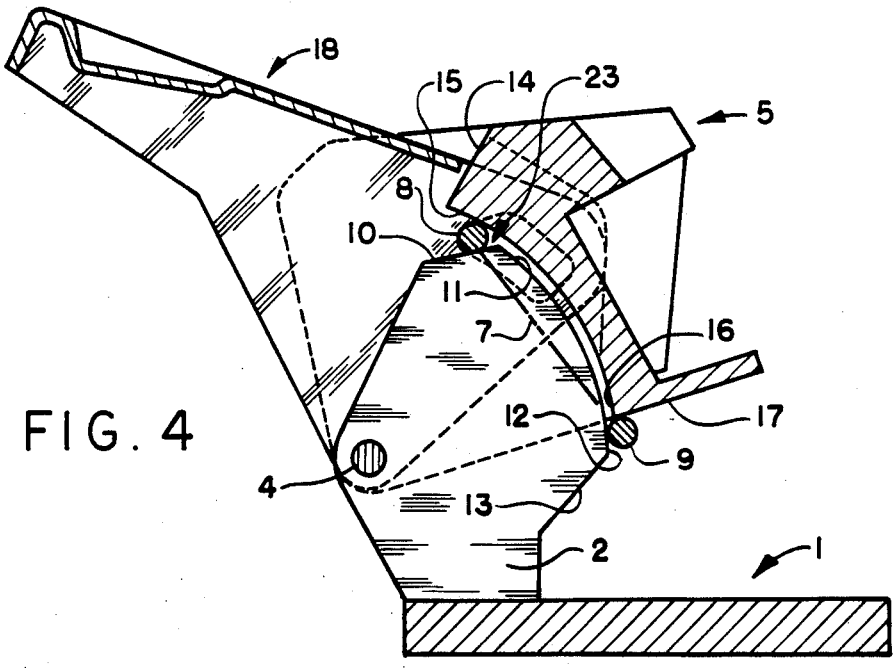
Figure 5:
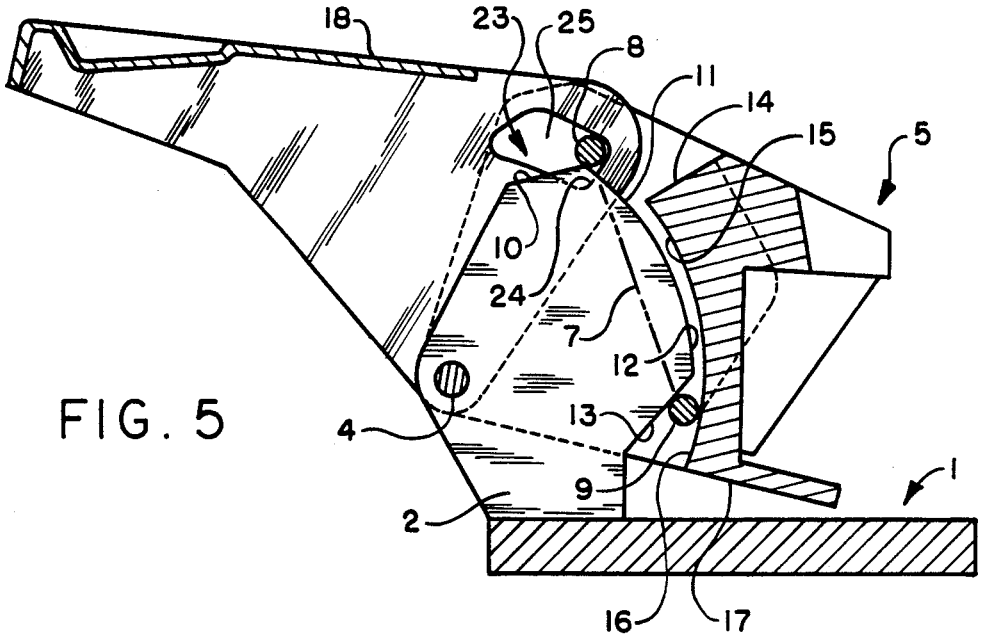

When the heelholding device is initially in its position for use shown in FIG. 1, and a force exceeding the initial stress of the helical tension spring 7 is exerted on the soleholder 5, the soleholder 5 will move about the pivot pin 4 in the counterclockwise direction, wherein surface 14 of soleholder 5 engages rolling member 8. Rolling member 8 is biased by helical tension spring 7 and is contrained to slide along surface 11 of support members 2, 3. Upon a decrease of the force, the soleholder 5 returns to its initial position under the influence of the helical tension spring 7. If a sufficiently strong force in an upward direction is exerted on the heelholder to in turn exert an upward force on the soleholder of a large enough value to require release, e.g., during a forward fall of the skier, the rolling member 8, 9 will move to the surfaces 10 and 17 of the support member 2, 3 and soleholder respectively. As a result, the soleholder 5 is biased by the helical tension spring 7 to the opening position. FIG. 3 illustrates the respective components of the device in the position assumed when the force exerted on the soleholder 5 has reached the limit required for release. FIG. 4 shows the components in the position assumed when the device is "opened" or "released".

In the opened position shown in FIG. 4, the heelholding device is ready to receive a boot. As the boot is inserted in soleholder 5, the load applied to the closing pedal 6 causes the soleholder 5 to swivel or pivot about the pivot pin 4 in a clockwise direction. Such movement is initially opposed by the force of the helical tension spring 7. The above-mentioned force required to release the soleholder 5 is now the force necessary to permit the device to close. When that value has been reached, the soleholder 5 is swivelled to its closed position by the helical tension spring 7.

For a manual opening of the heelholding device from the position shown in FIG. 1, the opening lever 18 is swivelled in a counterclockwise direction so that the rolling member 8 is entrained by the guiding portion 24 of the cam slot 23 in the opening lever 18. This action removes rolling member 8 from engagement with surface 14 of soleholder 5. Because the soleholder 5 has been released, it can swivel in the opening direction virtually without a need for an exertion of a force. As the rolling member 8 moves from the surface 11 of the soleholder 5 to surface 10 of the support members 2, 3, the soleholder 5 has performed a corresponding pivotal movement wherein rolling member 9 moves to the respective other surface of the lower tracks so that the soleholder 5 will then automatically move to its open position shown in FIG. 6.

Figure 6:
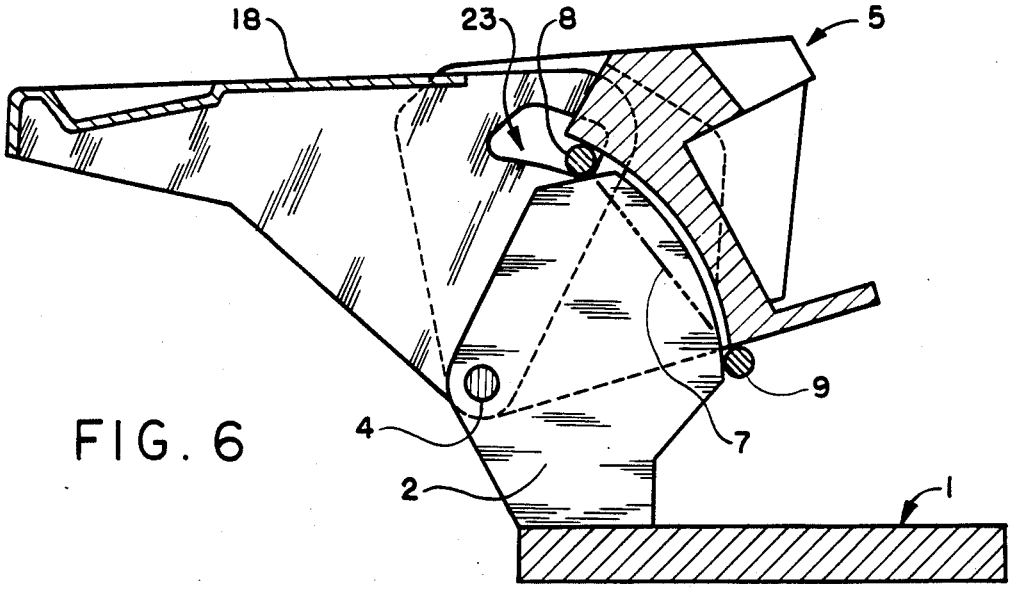

A comparison of FIGS. 4 and 6 will reveal that the opening lever 18 can move relative to the soleholder 5 because the cam slot 23 provides a clearance 25. That freedom of movement affords the advantage that the opening lever 18 is not compelled to follow all movements performed by the soleholder 5 during skiing. To ensure that the heelholding device has no freely movable part even it is in its open position, the opening lever 18 may be biased by a conventional retaining spring (not shown) which would, after an actuation of the opening lever 18, cause the latter to swivel from the position shown in FIG. 6 back to the position shown in FIG. 4. That spring may consist, e.g., of a helical torsion spring and may be movably mounted on the pivot pin 4 and with its second end may act on the soleholder 5 to bias it in an opening sense. In that case, the soleholder 5 can automatically swing up to an open position at the beginning of the actuation of the opening lever 18.

As shown in FIG. 2, several parts of the illustrated embodiment are mirror images of each other with respect to a vertical longitudinal plane. To provide an adequate space for the helical tension spring 7, the soleholder 5 provides an adequate clearance 26 on the inside (see FIG. 2) and a slot 27 on either side of the clearance 26 (see FIG. 1) to permit a movement of the flanges 21, 22 of the opening lever 18.

Instead of the described embodiment comprising the two support members 2, 3 with the helical tension spring 7 extending between them, the carrying member may be provided with a pin-like mounting portion, which is centrally disposed thereon, and two springs may be arranged on opposite sides of that mounting portion. Alternatively the two springs may be disposed outside the soleholder. In such an arrangement, the rolling members 8, 9 must have an adequate length and the slots permitting the relative movement must be formed in the side walls of the soleholder 5. In addition, the rolling member 8, 9 obviously need not be integral as has been assumed in the present case for the sake of simplicity. Those skilled in the art are aware that rolling members may consist of cylindrical sleeve members which may be mounted on an axle and which can be acted upon by the spring. Finally, a conventional adjusting device may readily be provided for an adjustment of the initial stress of the spring in accordance with a desired value of the force required for a release.

The invention has been described in detail with particular exphasis on the preferred embodiment thereof, but variations and modifications within the spirit and scope of the invention may occur to those skilled in the art to which the invention pertains.

I claim:

1. A heelpiece of a safety ski binding, said heelpiece comprising:

a base attachable to a ski;

opposed vertical support members mounted on said base, each support member including a track formed by an outwardly curved surface terminating in first and second end surfaces extending at an angle thereto;

a soleholder mounted on said support members for pivotal movement about an axis transverse to said support members between a closed position for securing a ski boot an open position for releasing said ski boot, said soleholder including a track formed by an inwardly curved surface terminating in first and second end surfaces extending at an angle thereto, said inwardly curved surface being contiguous with said outwardly curved surface and movable relative thereto such that said soleholder end surfaces are movable past said end surfaces of said support members;

a first movable roller operable to engage said first end surfaces and said curved surfaces of said support members and said soleholder;

a second movable roller operable to engage said second end surfaces and said curved surfaces of said support members and said soleholder;

tension means disposed between and connected to said first and second rollers for biasing said rollers toward each other, said rollers being maintained in a spaced apart location by said respective surfaces of said support members and said soleholder wherein said first roller is movable between engagement with said first end surface of said soleholder and said first end surface of said support members as said soleholder moves between said closed position and said open position, said tension means exerting a biasing force on said soleholder to maintain said soleholder in said closed position when said first roller is in engagement with said first end surface of said soleholder, and lever means pivotally mounted on said support members said lever means including a cam slot for receiving and guiding the ends of said first roller, said lever means being operable to move said first roller from engagement with said first end surface of said soleholder when said soleholder is in the closed position to engagement with said first end surfaces of said support members when said soleholder is in the open position wherein said second roller engages said second end surface of said support member when said soleholder is in said closed position, and wherein said second roller engages said second end surface of said soleholder when said soleholder is in said open position.

2. A heelpiece as defined in claim 1 wherein said soleholder and said lever are coaxially mounted to said support means.

3. A heelpiece as defined in claim 1 wherein the width of said slot is twice the diameter of said roller.

4. A heelpiece as defined in claim 1 wherein said slot extends in a direction which is tangential with respect to said axis.

5. A heelpiece as defined in claim 1 wherein said tension means is a helical tension spring.

6. A heelpiece as defined in claim 1 wherein said tension means is a gas spring.

* * * * *